US005382183A

United States Patent [19]

Rompré

[11] Patent Number: 5,382,183

[45] Date of Patent: Jan. 17, 1995

[54] ARTICULATED SUPPORT FOR MOUNTING AN OUTBOARD MOTOR TO THE TRANSOM OF A BOAT

[76] Inventor: Stéphane Rompré, 236, Belleau, Chicoutimi, Québec, Canada, G7H 2Y8

[21] Appl. No.: 157,520

[22] Filed: Nov. 26, 1993

[51] Int. Cl.[6] ..... B63H 21/26

[52] U.S. Cl. ..... 440/59; 440/61; 248/641

[58] Field of Search ..... 440/53, 58, 59, 61, 440/63, 62, 65; 248/641, 642

[56] References Cited

U.S. PATENT DOCUMENTS

| | | | |
|---|---|---|---|
| 1,690,435 | 11/1928 | Savage . | |
| 2,757,888 | 8/1956 | Branstrator | 440/59 X |
| 3,032,304 | 5/1962 | Machlan | 248/4 |
| 3,033,500 | 5/1962 | Graves | 248/4 |
| 3,146,756 | 9/1964 | Shimanckas | 115/41 |
| 3,283,738 | 11/1966 | Nelsen | 115/18 |
| 3,570,443 | 3/1971 | Dewhurst | 440/61 X |
| 3,874,318 | 4/1975 | Langley | 115/17 |
| 3,948,472 | 4/1976 | Metcalf | 248/4 |
| 4,708,670 | 11/1987 | Peters | 440/6 |
| 4,778,415 | 10/1988 | Knotts | 440/59 |
| 4,781,631 | 11/1988 | Uchida et al. | 440/63 |
| 4,813,897 | 3/1989 | Newman et al. | 440/61 |
| 4,890,811 | 1/1990 | Ehni | 248/642 |
| 4,931,027 | 6/1990 | Nakahama et al. | 440/63 X |

FOREIGN PATENT DOCUMENTS

| | | | |
|---|---|---|---|
| 2414440 | 1/1979 | France . | |
| 2509687 | 1/1983 | France | 440/53 |

*Primary Examiner*—Sherman Basinger

[57] ABSTRACT

The articulated support for mounting an outboard motor to the transom of a boat comprises a stationary support section secured to the boat's transom, and a movable support section to receive the outboard motor. A shorter arm has a proximate end connected to the stationary support section through a first pivot remote from the boat's transom, and a distal end connected to the movable support section through an upper pivot. A pair of longer arms have a proximate end connected to the stationary support section through a third pivot situated close to the transom of the boat, and a distal end connected to the movable support section through a lower pivot. A mechanism rotates the proximate and distal ends of the shorter and longer arms about the respective pivots in order to pivot the movable support section about the stationary support section. The first and third pivots are so positioned and spaced apart on the stationary support section, the upper and lower pivots are so positioned and spaced apart on the movable support section, and the lengths of the shorter and longer arms are so adjusted that the rotative axle of the outboard motor is horizontal in a lower position of the movable support section, and that the longer and shorter arms cross each other in an upper position of the movable support section to tilt the outboard motor forwardly.

7 Claims, 4 Drawing Sheets

ARTICULATED SUPPORT FOR MOUNTING AN OUTBOARD MOTOR TO THE TRANSOM OF A BOAT

BACKGROUND OF THE INVENTION

1. Field of the Invention

The present invention relates to an articulated support for mounting an outboard motor to the transom of a boat, comprising a stationary support section secured to the boat transom, a movable support section to receive the outboard motor, and a plurality of arms for pivotally interconnecting these stationary and movable support sections.

2. Brief Description of the Prior Art

As well known to those familiar with boating, shifting of an outboard motor mounted to the transom of a boat from a generally vertical or operating position in which the propeller is immersed in water and a generally horizontal or storage position in which the propeller is out of the water, is often required. Moreover, in some cases, tilting the outboard motor is not sufficient to bring it in a convenient storage position; the motor must also be lifted up by about 300 mm prior to be tilted. This is particularly true in the case of a sailboat as propulsion from the outboard motor is not used when wind is blowing. Most of the outboard motors presently available on the market are provided with a mounting assembly that enables easy shifting of the motor between at least the operating and storage positions. Usually, the mounting assembly is designed to minimize the effort required to shift the motor between the different positions.

Also, many articulated supports for mounting outboard motors to the transom of boats have been proposed in the past. Examples are disclosed in U.S. Pat. No. 3,948,472 (Metcalf) issued on Apr. 6, 1976, U.S. Pat. No. 3,874,318 granted to Langley on Apr. 1st, 1975, and U.S. Pat. No. 3,146,756 (Shimanckas) dated Sep. 1st, 1964.

More specifically, U.S. Pat. No. 3,948,472 discloses a mounting support for small outboard motors formed of four links of different lengths mounted into a pivotal trapezoidal arrangement. The pivotal trapezoidal arrangement will move the outboard motor along a substantially vertical path for several inches during initial upward movement thereof and will then tilt it into a substantially horizontal storage position.

U.S. Pat. No. 3,874,318 discloses a mounting support for a small outboard motor provided with an elongate tubular member. Upper and lower sleeves slide on that tubular member. A pair of short arcuate link units pivotally interconnect the lower sleeve with a mounting bracket secured to the transom of a boat, while a pair of long link units pivotally interconnect the upper sleeve with the mounting bracket. Pivoting of the short and long arms and sliding of the lower and upper sleeves on the tubular member will enable shifting of the outboard motor from a vertical to an horizontal position.

The outboard motor of U.S. Pat. No. 3,146,756 is mounted to the transom of a boat through an horizontal pivot. An arcuate gear segment is also mounted on the outboard motor while a worm gear mechanism, driven by means of a reversible electric motor is mounted to the transom of the boat. The worm gear mechanism engages the arcuate gear segment whereby rotation of the electric motor will shift the position of the outboard motor through rotation thereof about the horizontal pivot.

OBJECTS OF THE INVENTION

An object of the present invention is to improve the articulated outboard motor supports of the prior art.

SUMMARY OF THE INVENTION

More specifically, in accordance with the present invention, there is provided an articulated support for mounting to the transom of a boat an outboard motor provided with a propeller driven through a rotative axle, comprising:

- a stationary support section to be secured to the transom of the boat;
- a movable support section on which the outboard motor is to be mounted;
- shorter arm means having a proximate end connected to the stationary support section through a first pivot means remote from the transom of the boat, and a distal end connected to the movable support section through an upper pivot means;
- longer arm means having a proximate end connected to the stationary support section through a third pivot means situated between the first pivot means and the transom of the boat, and a distal end connected to the movable support section through a lower pivot means, the first, third, upper and lower pivot means being substantially parallel; and
- mechanical means for rotating the proximate and distal ends of the shorter and longer arm means about the respective pivot means in order to pivot the movable support section about the stationary support section.

The first and third pivot means are so positioned and spaced apart on the stationary support section, the upper and lower pivot means are so positioned and spaced apart on the movable support section, and the lengths of the shorter and longer arm means are so adjusted that the rotative axle of the outboard motor is horizontal in a lower position of the movable support section, and that the longer and shorter arm means cross each other in an upper position of the movable support section to tilt the outboard motor forwardly.

In accordance with a preferred embodiment of the articulated support in accordance with the invention, the first, third, upper and lower pivot means are so positioned and spaced apart on the stationary and movable support sections, in function of the length of the shorter and longer arm means that the rotative axle of the outboard motor is horizontal in a third position of the movable support section, slightly higher than the lower position. The rotative axle remains close to the horizontal between the third and lower positions.

Preferably, the distance between the first and third pivot means is greater than the distance between the upper and lower pivot means, the first and third pivot means are separated by a given horizontal distance and by a given vertical distance shorter than the horizontal distance, and the first, third, upper and lower pivot means are generally horizontal.

According to other preferred embodiments of the articulated support, the stationary support section defines a housing secured to the transom of the boat, the shorter arm means comprises a single arm having a proximate end situated within that housing, the housing comprises a slot through which the single arm extends for enabling rotation of this single arm about the first pivot means and therefore about the housing, the mechanical means are situated within the housing and comprises (a) a lever arm having a first end connected to the proximate end of the shorter arm means, and a second end, and (b) means mounted between the second end of the lever arm and the stationary support section for rotating the proximate end of the shorter arm means about the first pivot means.

The objects, advantages and other features of the present invention will become more apparent upon reading of the following non restrictive description of preferred embodiments thereof, given by way of example only with reference to the accompanying drawings.

DETAILED DESCRIPTION OF THE PREFERRED EMBODIMENTS

Figure 1:
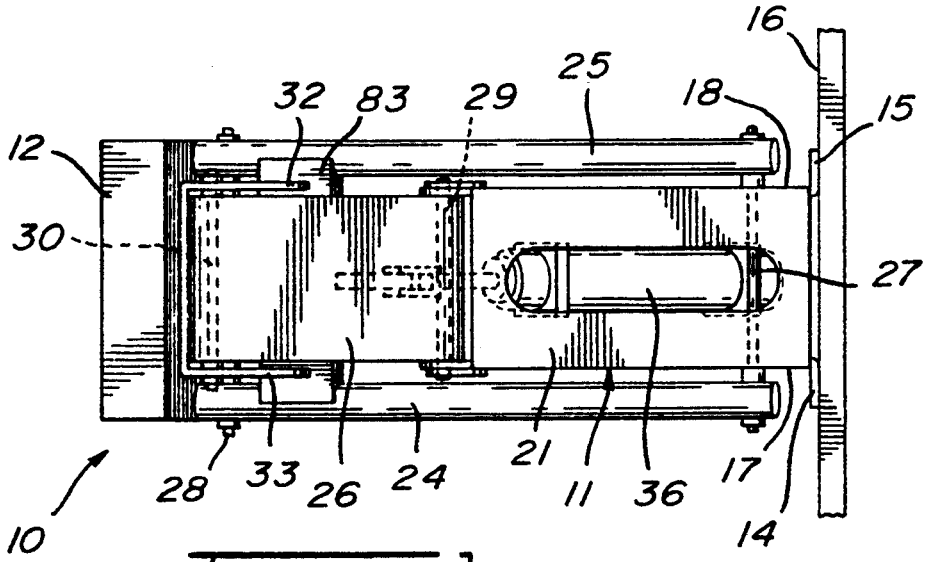
FIG. 1 is a top plan view of a first preferred embodiment of the articulated support in accordance with the present invention, for mounting an outboard motor to the transom of a boat.

The first preferred embodiment of the articulated support according to the invention, for mounting an outboard motor to the transom of a boat, in particular but not exclusively a sailboat, is generally identified by the reference 10 in FIGS. 1, 2, 3 and 4.

As illustrated in FIG. 1–4, the articulated support 10 comprises a stationary support section 11 and a movable support section 12.

The stationary support section 11 is advantageously made of stainless steel and comprises a vertical member 13 formed with lateral flanges 14 and 15 extending sidewards parallel to the transom 16 of the boat, as well as with spaced apart flanges 17 and 18 perpendicular to the transom 16 of the boat. As illustrated, the lateral flanges 14 and 15 are secured to the transom 16 of the boat by means of bolts such as 19 and 20 (FIGS. 2–4) to thereby mount the articulated support 10 to the boat transom. The stationary support section 11 also comprises a horizontal member 21 forming a single piece with the vertical member 13. Horizontal member 21 has a cross section presenting the shape of an inverted "U". Also, horizontal member 21 has a proximate end connected to the upper end of the vertical member 13 and a distal end connected to the lower end of vertical member 13 through a reinforcing member 22 U-shaped in cross section. For example, the two ends of the reinforcing member 22 can be riveted to the distal end of horizontal member 21 and to the lower end of vertical member 13, respectively. As can be appreciated, the stationary support section 11 defines a strong, rigid triangular structure.

Regarding the movable support section 12, it is formed of a thick plate, made of any suitable material, on which a conventional outboard motor 23 can be mounted in the manner known to those of ordinary skill in the art.

The stationary and movable support sections 11 and 12 are interconnected by means of two parallel, lateral tubular longer arms 24 and 25, and by means of a central shorter arm 26 situated between the longer arms 24 and 25. The longer arms 24 and 25 are linked together through a transversal brace 83 having two ends welded to the arms 24 and 25, respectively. The longer arms 24 and 25 form with the transversal brace 83 a H-shaped structure to provide the support 10 with additional torsional rigidity. The shorter arm 26 has a width smaller than the distance separating the two arms 24 and 25. The arms 24–26 are advantageously made of stainless steel.

The longer arms 24 and 25 have respective proximate ends pivotally connected to the stationary support section 11 through a horizontal and transversal pivot 27 situated close to the transom 16 of the boat, and extending between the lateral flanges formed by the U-shaped horizontal member 21. The respective distal ends of the longer arms 24 and 25 are pivotally connected to the movable support section 12 through a lower horizontal, transversal pivot 28.

The shorter arm 26 has a proximate end pivotally connected to the stationary support section 11 through a transversal and horizontal pivot 29 remote from the transom 16 of the boat. More specifically, pivot 29 is situated substantially at the same horizontal level as pivot 27 at the distal end of the horizontal member 21. Finally, the distal end of the shorter arm 26 is pivotally connected to the movable support section 12 through an upper horizontal, transversal pivot 30.

The lower and upper pivots 28 and 30 are mounted on the movable support section 12 through a piece 31 secured to one face of the plate 12. This piece 31 includes two lateral flanges 32 and 33 extending perpendicular to the plate 12. The lower pivot 28 extends between the two flanges 32 and 33. Each flange 32,33 is formed with an arcuate upper portion such as 34 including a plurality of holes such as 35 to receive the upper pivot 30. Therefore, by mounting the upper pivot 30 in the appropriate hole 35 of the upper portions 34 of the flanges 32 and 33, the inclination of the movable support section 12 is easily adapted to the angle defined by the boat transom with the vertical.

The support 10 is articulated by means of a double-action hydraulic cylinder 36. The lower portion of the vertical member 13 is formed with a first bracket 37 to pivotally receive the cylinder end of this hydraulic cylinder 36. The underside of the shorter arm 26 is formed with a second bracket 38 to pivotally receive the rod end of the hydraulic cylinder 36.

Figure 2:
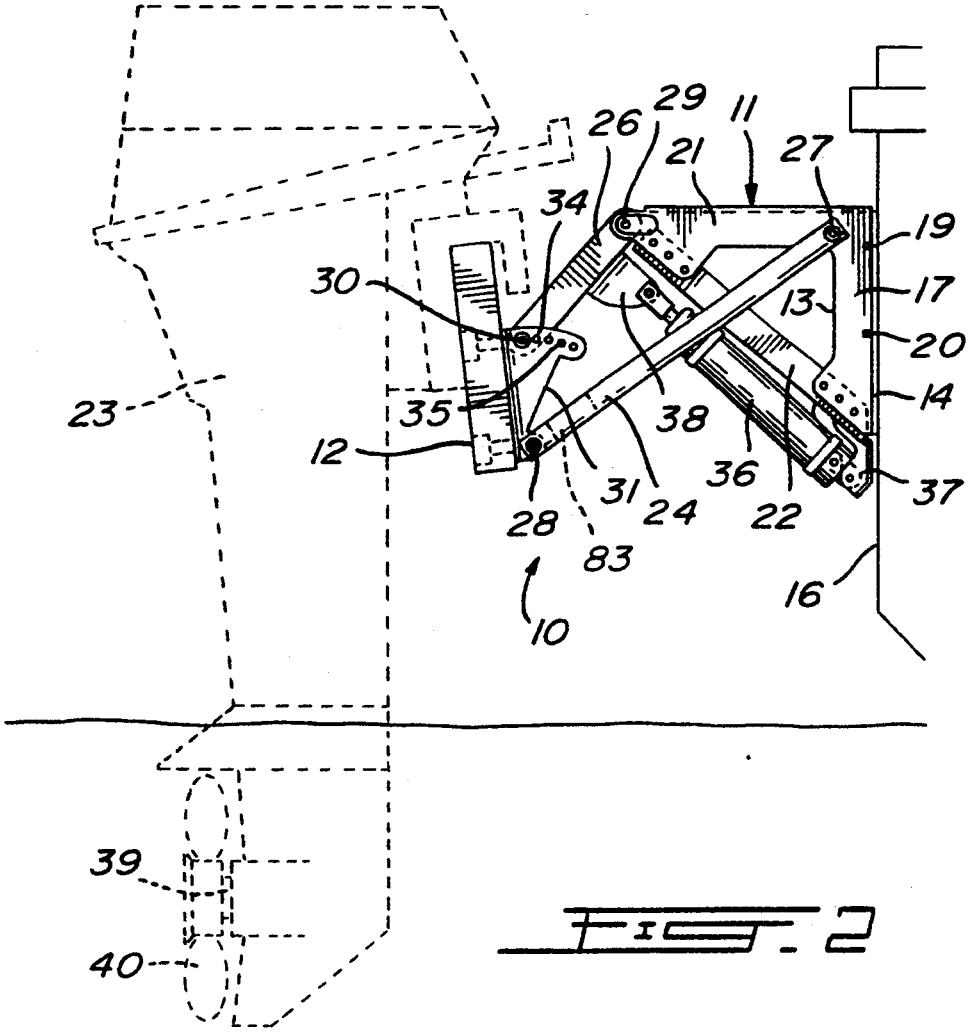
FIGS. 2, 3 and 4 are side elevational views of the first preferred embodiment of the articulated support according to the invention, respectively showing three different positions of the outboard motor.

FIG. 2 illustrates a lower position of the outboard motor 23, in which the rotative axle 39 of the propeller 40 is horizontal and in which the hydraulic cylinder 36 is completely retracted. As illustrated in FIG. 2, the propeller 2 is then immersed in water.

As the hydraulic cylinder 36 is extended, the longer 24,25 and shorter 26 arms are rotated about their respective pivots 27,28 and 29,30 to thereby pivot the movable support section 12 with respect to the stationary support section 11.

From the position of FIG. 2, the movable support section 12 and therefore the outboard motor 23 first follows a slightly arcuate course until it reaches a second position (illustrated in FIG. 3), slightly higher that the lower position of FIG. 2, in which the rotative axle 39 driving the propeller 40 of the outboard motor 23 is horizontal. In the latter position, the propeller 40 is still immersed but the outboard motor 23 is 107.4 mm higher than in the lower position of FIG. 2 (for the dimensional data given hereinafter).

The outboard motor 23 can therefore be used with the propeller 40 situated at two different levels where the axle 39 is horizontal. The motor can also be used in positions intermediate the two latter positions and in positions slightly higher than that of FIG. 3, since in this region of the overall stroke the angle between the axle 39 of the propeller 40 and the horizontal will remain small; it is equal to 8° at a height of 154.6 mm above the lower position of FIG. 2. A trim angle can also be beneficial in certain circumstances. As well known to those of ordinary skill in the art, these various positions are required for propelling a boat at low and higher speed.

Figure 3:
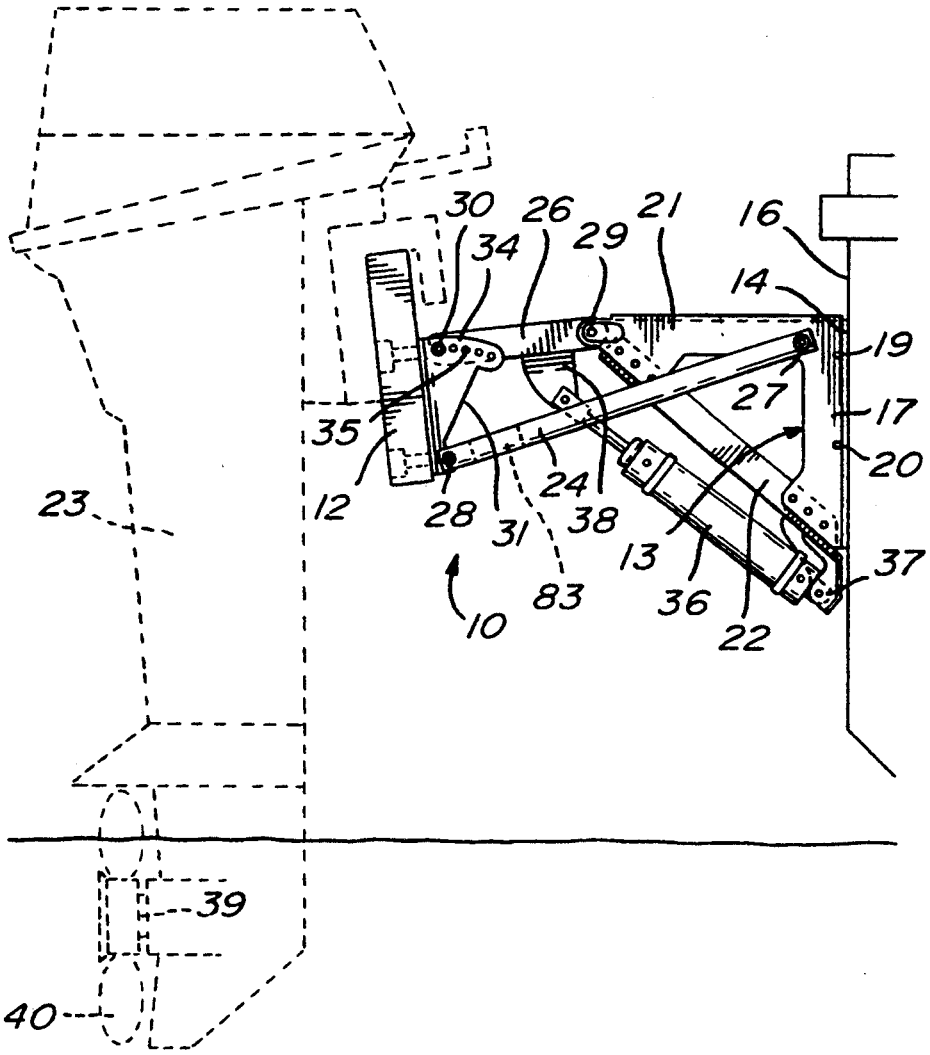

From the position of FIG. 3, the outboard motor 23 gradually tilts in a plane parallel to that of the boat's keel. Tilting movement becomes more pronounced as the hydraulic cylinder 36 extends and the outboard motor 23 is raised.

Figure 4:
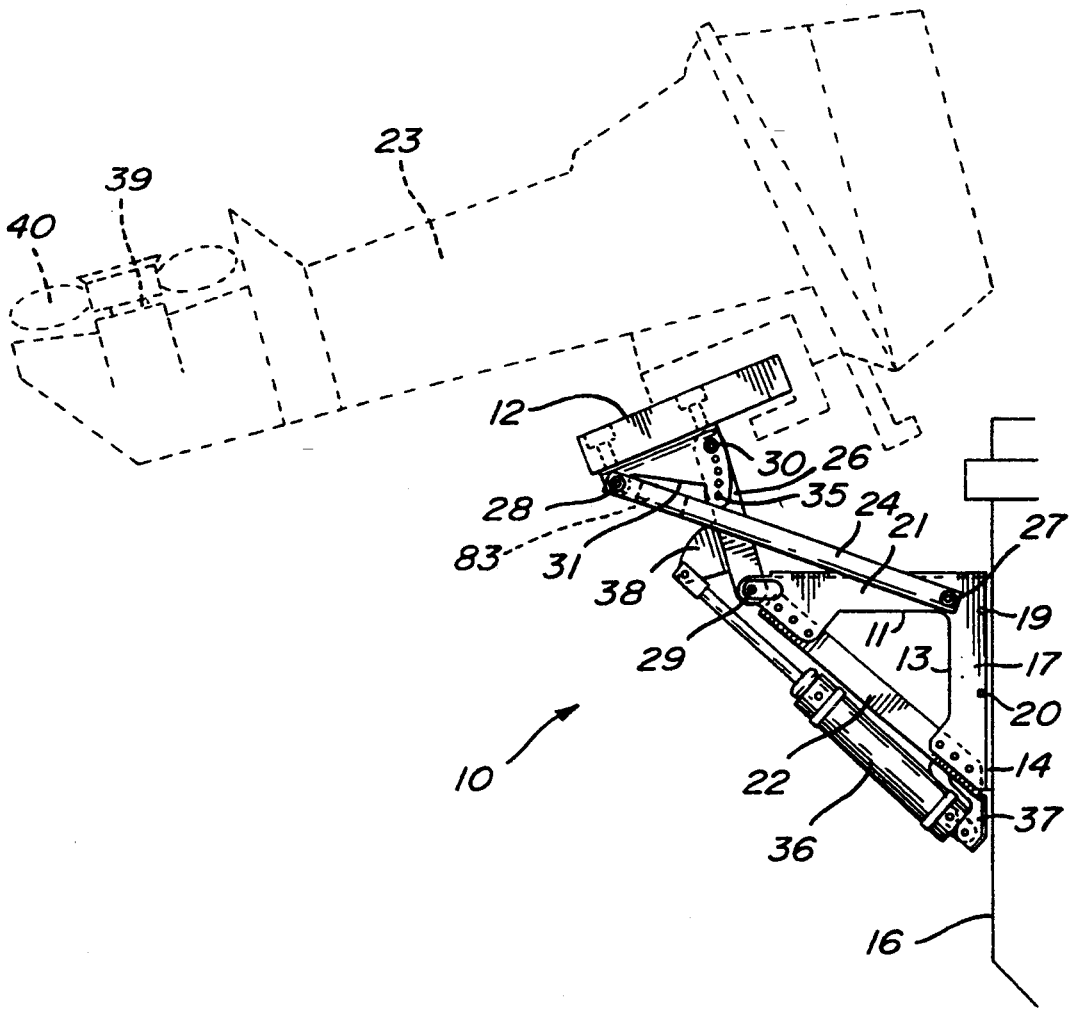

FIG. 4 illustrates the higher position of the outboard motor 23, suitable for sailing for instance. In this position, the hydraulic cylinder 36 is fully extended and the arm 26 cross the arms 24 and 25. The outboard motor 23 is also situated above the water, which is required to eliminate the drag caused by the immersed foot and non-rotating propeller of an outboard motor upon sailing. This position also protects the outboard motor 23, in particular its propeller 40, against collisions with floating objects such as logs.

In the higher position of FIG. 4, the outboard motor should be inclined at an angle of about 75° (with respect to the vertical) and is conveniently situated behind the plane of the transom 16 of the boat.

The movable support section 12 and therefore the outboard motor 23 can then be pivoted with respect to the stationary support section 11 from the position of FIG. 4 back to the position of FIG. 2 by retracting the double-action hydraulic cylinder 36. Alternatively, the hydraulic cylinder 36 is a single-action cylinder spring-biased for retraction thereof. The spring must then be sufficiently stiff to withstand the reverse thrust produced by the outboard motor.

It should be noted that the hydraulic cylinder 36 can be supplied by an hydraulic pump located in the bilge of the boat via hoses going through ports in the transom 16.

The above described movement is obtained through appropriate selection of the lengths of the longer 24,25 and shorter 26 arms and the coordinates of the pivots 27–30 (positions thereof and distances between them). For a commercial prototype, the following characteristics and values have been selected:

Length of the shorter arm 26=190 mm;

Length of the longer arms 24 and 25=450.1 mm;

Horizontal distance between the pivots 27 and 29=250 mm;

Vertical distance between the pivots 27 and 29=10 mm;

Distance separating the pivots 28 and 30=130 mm;

Angle of the shorter arm 26 with respect to the horizontal in the lower position of FIG. 2=45°;

Angle of the longer arms 24 and 25 with the horizontal in the lower position of FIG. 2=34.15°;

Distance between the outboard motor 23 and the transom 16 of the boat in the lower position of FIG. 2 (for aesthetic reasons the motor 23 must be as close as possible to the transom 16)=440 mm;

Vertical distance between the two positions of the outboard motor 23 in which the axle 39 of the propeller 40 is horizontal=107.4 mm;

Maximal angular deviation of the axle 39 of the propeller 40 between the two positions of the outboard motor 23 in which the axle 39 is horizontal=2.67°; and Vertical distance between the lower position of FIG. 2 and the position of the outboard motor 23 in which the axle 39 of the propeller 40 has tilted by an angle of 8°=154.6 mm.

Figure 5:
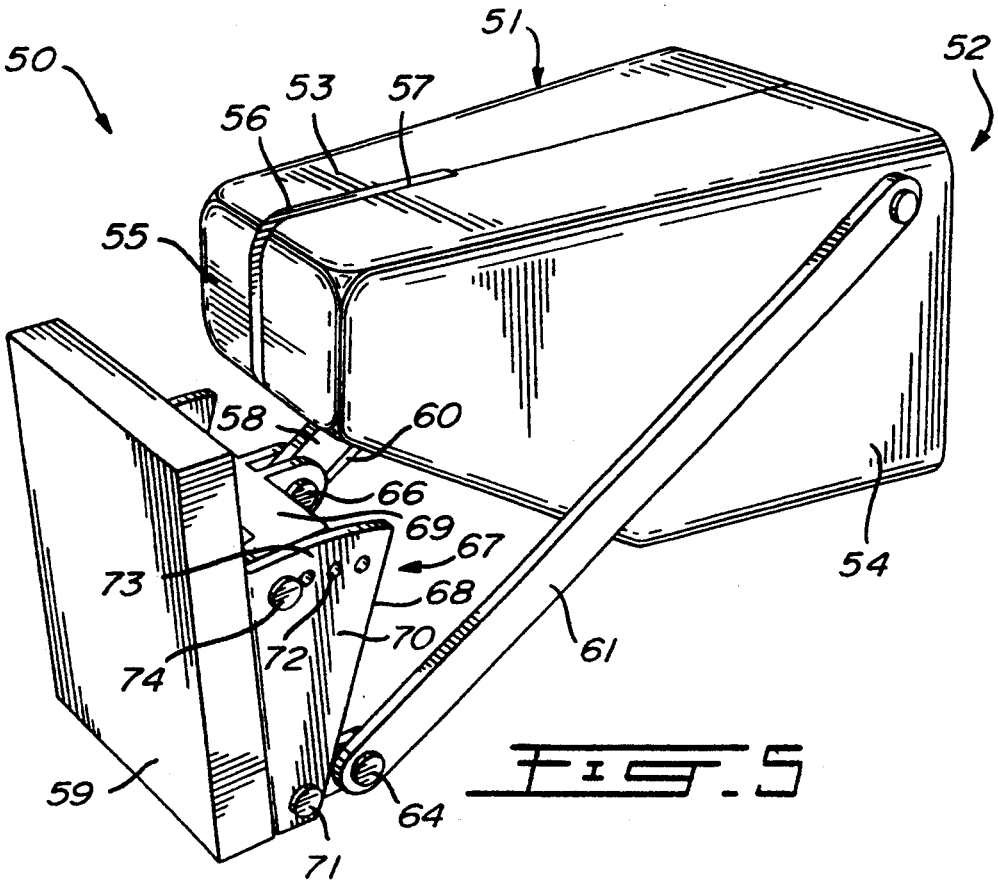
FIG. 5 is a perspective view of a second preferred embodiment of the articulated support in accordance with the present invention, for mounting an outboard motor to the transom of a boat.
Figure 6:
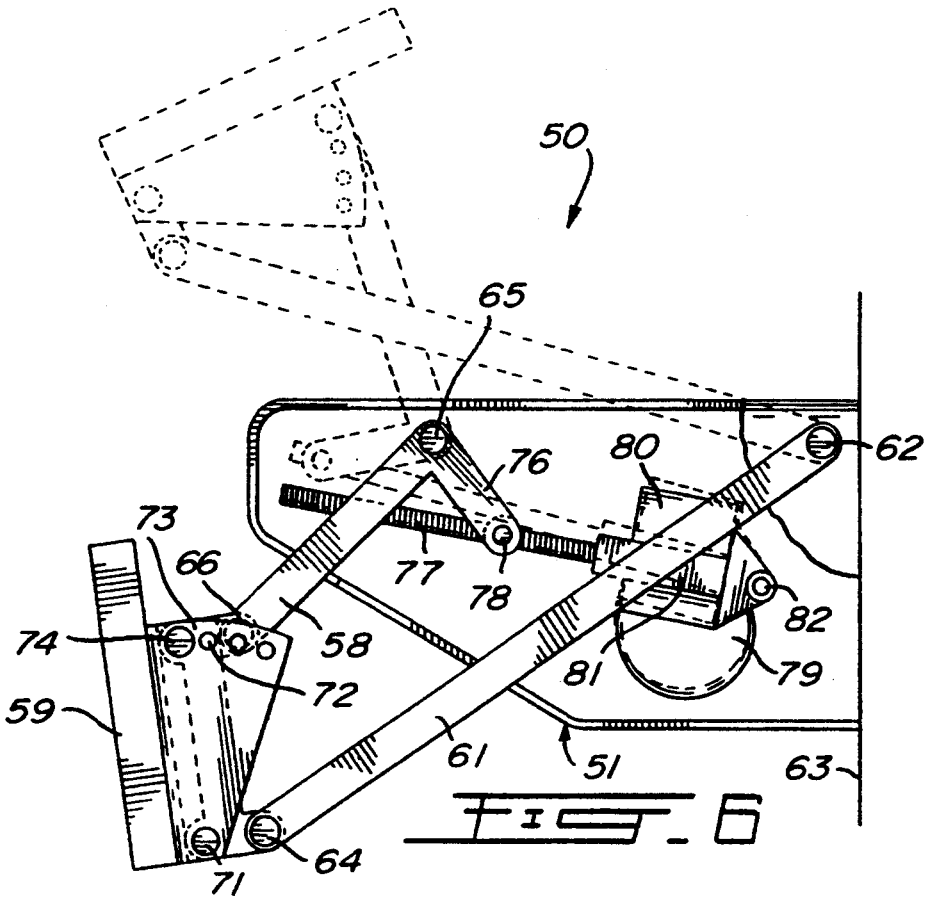
FIG. 6 is a side elevational view, partially cross sectional, of the second preferred embodiment of the articulated support.

The second preferred embodiment of the articulated support according to the invention, for mounting an outboard motor to the transom of a boat, in particular but not exclusively a sailboat, is generally identified by the reference 50 in FIGS. 5 and 6.

The stationary support section of this second preferred embodiment comprises a cast aluminum housing 51 having an end 52 that can be bolted to the transom 63 (FIG. 6) of a boat. The housing 51 is formed of two lateral housing portions 53 and 54 that can be assembled together in a conventional manner. The free end 55 is formed with a U-shaped slot 56 lying in a vertical plane perpendicular to the transom of the boat. The slot 56 is provided with a water seal 57 allowing passage of an arm 58 through the slot 56.

Regarding the movable support section, it is formed of a thick plate 59, made of any suitable material, on which a conventional outboard motor can be mounted in the manner known to those of ordinary skill in the art.

The stationary and movable support sections are interconnected by means of two parallel, lateral longer arms 60 and 61, and by means of a central shorter arm 58 situated between the longer arms 60 and 61. The arms 58, 60 and 61 are rectangular in cross section and advantageously made of steel.

The longer arms 60 and 61 have respective proximate ends pivotally connected to opposite sides of the housing 51 through a horizontal and transversal pivot 62 situated close to the transom 63 of the boat, and passing though the housing 51. The respective distal ends of the longer arms 60 and 61 are pivotally connected to the plate 59 through a lower horizontal, transversal pivot 64.

The shorter arm 58 has a proximate end pivotally connected to the housing 51 through a transversal and horizontal pivot 65 remote from the transom 63 of the boat. As illustrated in FIG. 6, pivots 62 and 65 are situated substantially at the same horizontal level. The distal end of the shorter arm 58 is pivotally connected to the plate 59 through an upper horizontal, transversal pivot 66. As can be seen in FIGS. 5 and 6, the shorter arm 58 extends through the slot 56.

The lower and upper pivots 64 and 66 are mounted on the plate 59 through a mechanism 67 including a U-shaped piece 68 secured to one face of the plate 59, and a frame 69 on which the pivots 64 and 66 are mounted. The U-shaped piece 68 includes two lateral flanges such as 70 extending perpendicular to the plate 59. The frame 69 is mounted on the U-shaped piece 68 through a lower horizontal and transversal pivot 71 extending between the two flanges 70 and an upper horizontal and transversal pivot 72 also extending between the two flanges 70. Each flange 70 is formed with an arcuate upper portion 73 including a plurality of holes such as 74 to receive the upper pivot 72. Therefore, by mounting the upper pivot 72 in the appropriate hole 74 of the upper portions 73 of the flanges 70, the inclination of the plate 59 is easily adapted to the angle defined by the transom 16 with respect to the vertical.

The proximate end of the shorter arm 58 is formed with an extension 76 disposed angularly with respect to the arm 58 to form an L-shaped arm. The free end of the extension 76 is pivotally connected to an endless screw 77 through a transversal and horizontal pivot 78 formed with a threaded nut member (not shown) engaging the endless screw 77. The endless screw 77 is rotated by means of a reversible electric motor 79 through a gear reducer 80, the endless screw 77 rotating in a sleeve 81. The assembly motor 79-gear reducer 80-sleeve 81 is pivotally mounted in the housing 51 through a transversal and horizontal pivot 82. As can be appreciated, the arm extension 76, endless screw 77, gear reducer 80, and electrical motor 79 are located within the housing 51.

In operation the electric motor 79 is rotated to rotate the endless screw 77 and move the free end of the arm extension 76 along that endless screw 77 and thereby pivot the arms 58, 60 and 61 about their respective pivots 62, 64, 65 and 66. Motor 79 is rotated in a first direction to move the plate 59 from a lower position shown in full line in FIG. 6 to a higher position shown in dashed line. Rotation of the motor 79 in the opposite direction will return the plate 59 from the higher to the lower position.

The operation of the second preferred embodiment 50 (FIGS. 5 and 6) of the articulated support in accordance with the present invention is otherwise the same as that, described in the foregoing description, of the first preferred embodiment 10 of FIGS. 1–4.

However, the second embodiment 50 of FIGS. 5 and 6 presents the advantage that the driving mechanism is located within the housing 51 and is thereby protected against bad weather conditions.

Although the present invention has been described hereinabove by way of preferred embodiments thereof, these embodiments can be modified at will, within the scope of the appended claims, without departing from the spirit and nature of the invention.

What is claimed is:

1. An articulated support for mounting to the transom of a boat an outboard motor provided with a propeller driven through a rotative axle, and for moving said outboard motor between a lower position in which the propeller is immersed in water, an intermediate position higher than said lower position but in which said propeller is at least partially immersed in water, and an upper position, comprising:

a stationary support section to be secured to the transom of the boat;

a movable support section on which the outboard motor is to be mounted;

shorter arm means having a proximate end connected to said stationary support section through a first pivot means distant from the transom of the boat, and a distal end connected to the movable support section through a second upper pivot means;

longer arm means having a proximate end connected to the stationary support section through a third pivot means situated between the first pivot means and the transom of the boat, and a distal end connected to the movable support section through a fourth lower pivot means, said first, second, third and fourth pivot means being substantially parallel; and mechanical means for rotating said proximate and distal ends of the shorter and longer arm means about the respective pivot means in order to pivot said movable support section about said stationary support section and thereby move the outboard motor between said lower, intermediate and upper positions;

wherein the first and third pivot means are positioned and spaced apart on the stationary support section and wherein the second and fourth pivot means are positioned and spaced apart on the movable support section in function of the lengths of said shorter and longer arm means to form an arrangement in which (a) the rotative axle of the outboard motor is horizontal in both the lower and intermediate positions of the outboard motor but is not horizontal between said lower and intermediate positions, and (b) the longer and shorter arm means cross each other in said upper position of the outboard motor to tilt said outboard motor forwardly.

2. An articulated support as recited in claim 1, in which said first and third pivot means are situated substantially at the same horizontal level.

3. An articulated support for mounting to the transom of a boat an outboard motor provided with a propeller driven through a rotative axle, comprising:

a stationary support section to be secured to the transom of the boat;

a movable support section on which the outboard motor is to be mounted;

shorter arm means having a proximate end connected to said stationary support section through a first pivot means distant from the transom of the boat, and a distal end connected to the movable support section through a second upper pivot means;

longer arm means having a proximate end connected to the stationary support section through a third pivot means situated between the first pivot means and the transom of the boat, and a distal end connected to the movable support section through a fourth lower pivot means, said first, second, third and fourth pivot means being substantially parallel; and mechanical means for rotating said proximate and distal ends of the shorter and longer arm means about the respective pivot means in order to pivot said movable support section about said stationary support section;

wherein the first and third pivot means are positioned and spaced apart on the stationary support section and wherein the second and fourth pivot means are positioned and spaced apart on the movable support section in function of the lengths of said shorter and longer arm means to form an arrangement in which (a) the rotative axle of the outboard motor is horizontal in a lower position of said movable support section, and (b) the longer and shorter arm means cross each other in an upper position of the movable support section to tilt the outboard motor forwardly; and wherein (a) said stationary support section defines a housing secured to the transom of the boat, (b) said shorter arm means comprise a single arm of which the proximate end is situated within said housing, (c) said housing comprises a slot through which said single arm extends for enabling rotation of said single arm about said first pivot means and therefore about said housing, and (d) said mechanical means are situated within said housing and comprise means, mounted between said housing and said proximate end of the single arm for rotating said proximate end of the single arm about said first pivot means.

4. An articulated support as recited in claim 3, wherein the longer arm means comprise two arms having respective proximate ends mounted on the third pivot means on opposite sides of said housing, and wherein said single arm is situated between said two arms.

5. An articulated support for mounting to the transom of a boat an outboard motor provided with a propeller driven through a rotative axle, comprising:

a stationary support section to be secured to the transom of the boat;

a movable support section on which the outboard motor is to be mounted;

shorter arm means having a proximate end connected to said stationary support section through a first pivot means distant from the transom of the boat, and a distal end connected to the movable support section through a second upper pivot means;

longer arm means having a proximate end connected to the stationary support section through a third pivot means situated between the first pivot means and the transom of the boat, and a distal end connected to the movable support section through a fourth lower pivot means, said first, second, third and fourth pivot means being substantially parallel; and mechanical means for rotating said proximate and distal ends of the shorter and longer arm means about the respective pivot means in order to pivot said movable support section about said stationary support section;

wherein the first and third pivot means are positioned and spaced apart on the stationary support section and wherein the second and fourth pivot means are positioned and spaced apart on the movable support section in function of the lengths of said shorter and longer arm means to form an arrangement in which (a) the rotative axle of the outboard motor is horizontal in a lower position of said movable support section, and (b) the longer and shorter arm means cross each other in an upper position of the movable support section to tilt the outboard motor forwardly; and wherein said mechanical means comprise (a) a lever arm having a first end connected to said proximate end of the shorter arm means, and a second end, and (b) means mounted between said second end of the lever arm and said stationary support section for rotating said proximate end of the shorter arm means about the first pivot means through the lever arm.

6. An articulated support as recited in claim 1, wherein, in said lower position of the outboard motor, the shorter and longer arm means are convergent toward the movable support section and wherein, in said intermediate position of the outboard motor, the shorter and longer arm means are divergent toward the movable support section.

7. An articulated support as recited in claim 1, wherein:

the distance between said first and third pivot means is longer than the distance between said second and fourth pivot means;

said first and third pivot means are situated nearly at the same horizontal level;

in said lower and intermediate positions of the outboard motor, said second and fourth pivot means are nearly vertical with respect to each other;

in said lower position of the outboard motor, the shorter and longer arm means are convergent toward the movable support section; and in said intermediate position of the outboard motor, the shorter and longer arm means are divergent toward the movable support section.

* * * * *